US009127391B2

(12) United States Patent
Acharya et al.

(10) Patent No.: US 9,127,391 B2
(45) Date of Patent: Sep. 8, 2015

(54) DEVICE FOR DISPENSING AN ADDITIVE IN AN APPLIANCE

(75) Inventors: Alaknanda Acharya, Louisville, KY (US); Mohan Rao Ponnaganti, Andhra Pradesh (IN); David Scott Dunn, Smithfield, KY (US)

(73) Assignee: General Electric Company, Schenectady, NY (US)

( * ) Notice: Subject to any disclaimer, the term of this patent is extended or adjusted under 35 U.S.C. 154(b) by 986 days.

(21) Appl. No.: 13/211,633

(22) Filed: Aug. 17, 2011

(65) Prior Publication Data

US 2013/0042653 A1 Feb. 21, 2013

(51) Int. Cl.

| | |
|---|---|
| ***D06F 39/02*** | (2006.01) |
| ***D06F 35/00*** | (2006.01) |
| ***D06F 33/02*** | (2006.01) |
| *A47L 15/44* | (2006.01) |

(52) U.S. Cl.

CPC ..... *D06F 39/02* (2013.01); *A47L 15/44* (2013.01); *A47L 15/4418* (2013.01); *A47L 2501/01* (2013.01); *A47L 2501/07* (2013.01); *D06F 33/02* (2013.01); *D06F 39/022* (2013.01); *D06F 2204/086* (2013.01)

(58) Field of Classification Search

CPC ..... D06F 39/02; D06F 39/022; D06F 33/02; D06F 2204/086

USPC ..... 68/12.18, 17 R

See application file for complete search history.

(56) References Cited

U.S. PATENT DOCUMENTS

| | | | | |
|---|---|---|---|---|
| 4,009,598 | A | 3/1977 | Bernard et al. | |
| 6,301,734 | B1 | 10/2001 | Dunsbergen et al. | |
| 6,401,499 | B1 | 6/2002 | Clark et al. | |
| 6,773,668 | B1 * | 8/2004 | Everson et al. | 422/28 |
| 7,036,175 | B2 | 5/2006 | Sears et al. | |
| 7,313,934 | B2 * | 1/2008 | Heo et al. | 68/17 R |
| 7,802,335 | B2 | 9/2010 | Hoppe et al. | |
| 8,312,745 | B2 * | 11/2012 | Hasse et al. | 68/12.18 |
| 8,448,480 | B2 * | 5/2013 | Hasse et al. | 68/17 R |
| 2005/0121058 | A1 * | 6/2005 | Furber et al. | 134/93 |
| 2005/0241072 | A1 * | 11/2005 | Kim et al. | 8/158 |
| 2007/0163307 | A1 | 7/2007 | Kramme et al. | |
| 2007/0261177 | A1 | 11/2007 | Risen et al. | |
| 2010/0000578 | A1 | 1/2010 | Hendrickson et al. | |
| 2010/0000586 | A1 | 1/2010 | Hendrickson | |
| 2011/0067456 | A1 * | 3/2011 | Quandt | 68/12.18 |
| 2011/0247147 | A1 * | 10/2011 | Amos et al. | 8/137 |
| 2011/0277515 | A1 * | 11/2011 | Doh | 68/17 R |
| 2012/0017653 | A1 * | 1/2012 | Doh | 68/17 R |

OTHER PUBLICATIONS

Siemens "Free-standing appliances" 2007, Product Catalog, 103 pages.

* cited by examiner

*Primary Examiner* — Joseph L Perrin

(74) *Attorney, Agent, or Firm* — Dority & Manning, P.A.

(57) ABSTRACT

An appliance has a dispensing device that is configured for self-cleaning. In one embodiment, a flow regulator is fluidly connected to the dispensing device. The flow regulator has a first state in which a washing fluid is dispensed into the dispensing device and a second state in which the washing fluid is evacuated therefrom. To facilitate cleaning, the washing fluid flows through a spray device that is configured to direct the washing fluid onto a peripheral wall of a compartment in which an additive for the dispensing device can be disposed.

19 Claims, 8 Drawing Sheets

DEVICE FOR DISPENSING AN ADDITIVE IN AN APPLIANCE

BACKGROUND OF THE INVENTION

1. Field of the Invention

The subject matter disclosed herein relates generally to appliances and more particularly, to embodiments of a dispensing device that are used to retain and dispense an additive (e.g., laundry detergent) into a wash tub in the appliance, wherein the dispensing device is configured for self-cleaning.

2. Description of Related Art

Appliances such as washing machines come in various configurations including top-load and front-load configurations that define by orientation the way in which an end user loads objects (e.g., articles of clothing) for cleaning. Regardless of the configuration, however, these washing machines generally include a cabinet in which is disposed a wash tub for containing wash water and rinse water. A wash basket that receives the articles is rotatably mounted within the wash tub, and in certain configurations an agitating element is rotatably positioned within the wash basket. One or more of the wash basket and the agitating element is coupled to a drive assembly and a brake assembly, both of which are positioned with respect to the wash tub and configured to rotate and control the agitation of the wash basket. A pump assembly is also included to drain soiled water to a draining system.

Washing machines also include a dispenser assembly, which is located and often affixed to an inner portion of the cabinet. The dispenser assembly is compatible with additives for cleaning the articles, including detergents and bleach, both of which come in liquid and powder forms. The dispenser assembly includes, for example, a reservoir in which the additive is held before it is dispensed into the wash tub during operation of the appliance. In washing machines wherein the reservoir is sized and configured for a single-use or single-load configuration, access to the reservoir is provided so the end user can fill the reservoir with the additive for each separate load of articles that is washed in the washing machine.

To alleviate intervention and to eliminate the need for frequent replenishing of the reservoir by the end user, in some washing machines, the dispenser assembly is configured to hold enough additive for several loads of articles. Often referred to as "bulk" dispensers, these assemblies may require regular cleaning before changes are made to the type of additive stored therein or because additives such as liquid and diluted powder-like detergents are of relatively high viscosity and may coagulate or otherwise solidify, thereby reducing the effectiveness of the dispenser assembly.

There is a need, therefore, for a dispensing device that is configured as a bulk dispenser and that is configured for self-cleaning.

BRIEF SUMMARY OF THE INVENTION

Broadly stated, embodiments of the dispensing device discussed herein improve the operation of appliances such as washing machines. These appliances are equipped with dispensing devices that dispense or otherwise distribute additives (e.g., detergents) and treating chemistries to a wash zone in which objects are positioned to be washed. For some configurations of dispensing devices, such as those devices configured to hold enough additive for several (e.g., more than one) operations of the appliance, periodic cleaning of the dispensing device is preferred to avoid disruptions and/or to prevent diminished operation of the dispensing device. The dispensing devices described below address these and/or other concerns, where the dispensing devices are configured with self-cleaning capabilities to maintain the dispensing device in working order.

In one embodiment, an appliance comprises a wash tub forming a wash zone in which objects can be positioned to be washed and a fluid supply for delivering washing fluid to the wash zone. The appliance also comprises a dispensing device configured with a compartment in which an additive can be disposed having an inlet for receiving washing fluid from the supply and an outlet for dispensing additive to the wash zone. The appliance further comprises a flow regulator fluidly connecting the fluid supply to the input of the dispensing device and fluidly connecting the outlet of the dispensing device to the wash zone. In one example, the flow regulator has a first state in which a washing fluid is dispensed into the compartment via the inlet and a second state in which the washing fluid is evacuated from the compartment via the outlet.

In another embodiment, a method comprising receiving an input indicative of a condition in which a dispensing device requires cleaning, outputting a first signal to a flow regulator, which when received by the flow regulator changes the state of the flow regulator to dispense a washing fluid into a compartment of the dispensing device in which an additive can be disposed, and outputting a second signal to the flow regulator, which when received by the flow regulator changes the state of the flow regulator to evacuate a mixture formed in the compartment and comprising the washing fluid.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
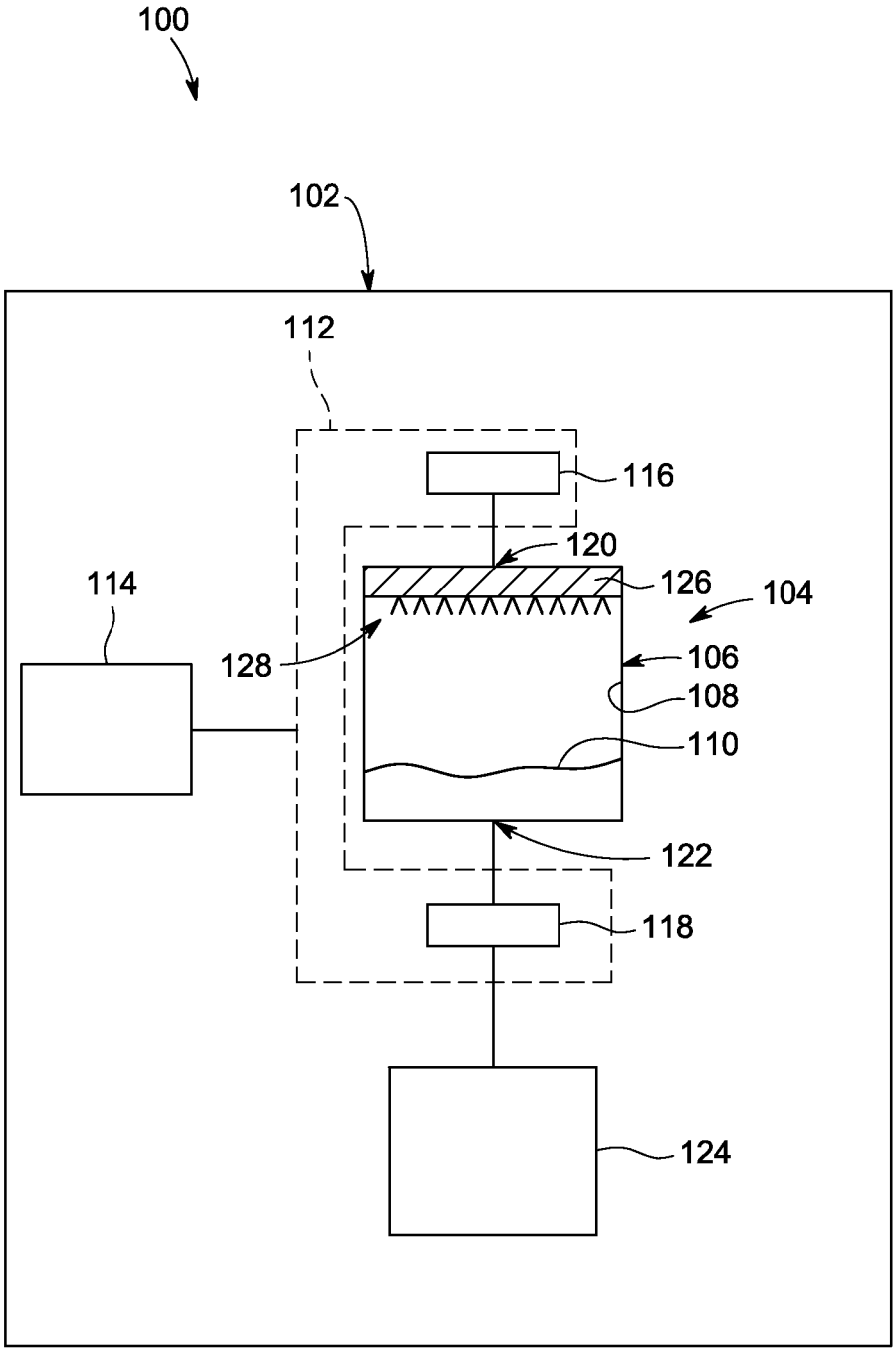
FIG. 1 is a schematic diagram of a side view of an exemplary embodiment of an appliance.
Figure 6:
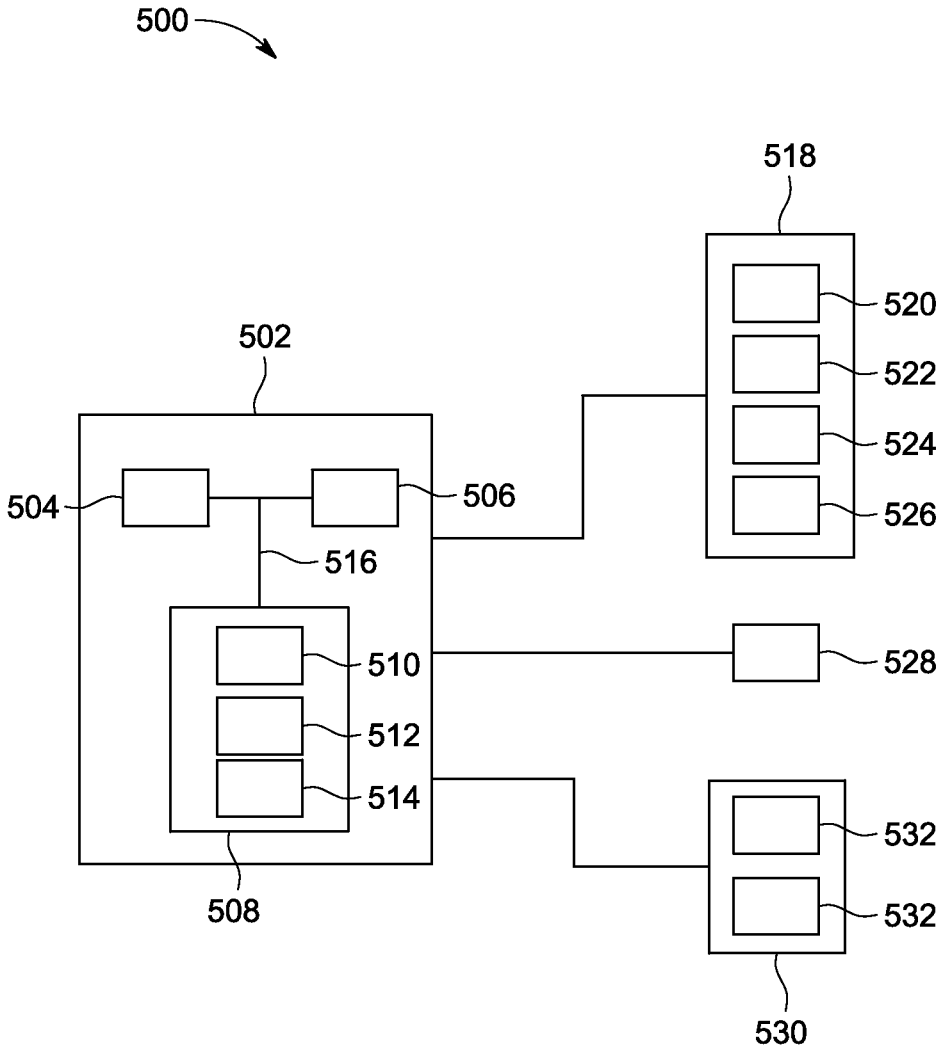
FIG. 6 is a schematic diagram of an example of a control scheme for use with an appliance such as the appliances of FIGS. 1-3.
Figure 7:
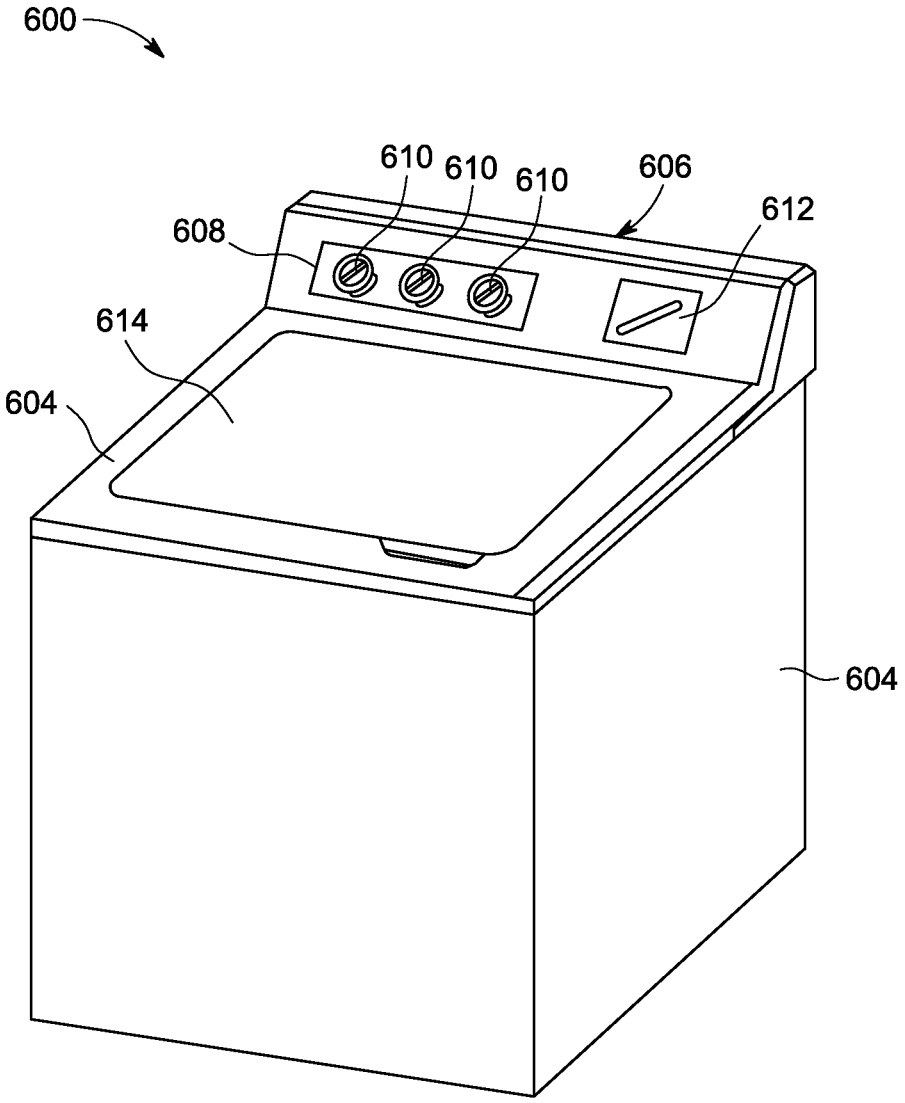
FIG. 7 is a perspective view of a washing machine embodying the concepts of the appliances of the present disclosure, such as the appliances of FIGS. 1-3.

FIG. 1 depicts one exemplary embodiment of a dispensing device deployed on an appliance 100. The appliance 100 comprises a washing machine 102, which may be a clothes washing machine of either the vertical-axis (as illustrated in FIGS. 6 and 7 and described below) and/or the horizontal-axis variety. A dispensing device 104 is disposed in the washing machine 102. The dispensing device 104 comprises a compartment 106 formed by a peripheral wall 108 and configured to retain an additive 110 therein. The additive 110 may be in fluid form (e.g., liquid) and solid form (e.g., granular). The additive 110 may comprise treating chemistries of any type of aid for treating fabric. Examples may include, but are not limited to, detergents and oxidizers (e.g., bleach), fabric softeners, sanitizers, de-wrinklers, and chemicals for imparting desired properties to the fabric. These properties include stain resistance, fragrance (e.g., perfumes), insect repellency, and ultra-violet (UV) protection.

In the embodiment of FIG. 1 a flow regulator 112 is fluidly connected to the dispensing device 104 and to a controller 114. The flow regulator 112 comprises a first flow device 116 (alternatively, an "inlet device 116") and a second flow device 118 (alternatively, an "outlet device 118"). The first flow device 116 is fluidly connected to an inlet 120 and the second flow device 118 is fluidly connected to an outlet 122 and to a wash tub 124. The wash tub 124 defines a wash zone in which objects to be washed can be positioned. Proximate the compartment 106 of the dispensing device 104 is a spray device 126, which is configured to inject a washing fluid 128 (e.g., water) into the compartment 106.

Dispensing of the washing fluid 128 creates a mixture of washing fluid and additive residue in the compartment 106. In one construction the spray device 126 directs the washing fluid 128 onto the peripheral wall(s) 108, thereby diluting and/or flushing any residue of the additive 110 that may be disposed thereon. The resulting mixture is thereafter evacuated from the compartment 106 by operation of the flow regulator 112, leaving the compartment 106 clean and substantially free of additive residue. In one example, the compartment 106 is configured so the washing fluid 128 flows by gravity from the outlet 122.

The controller 114 is configured to execute one or more machine-readable and/or machine-executable instructions that, when executed by the controller 114, change the state of the flow regulator 112 and control a flow of the washing fluid 128 and the mixture into and/or out of the compartment 106. Such instructions may be in the form of, e.g., software and/or firmware. In one example, the flow regulator 112 has a first or dispensing state in which the washing fluid 128 is dispensed into the compartment 106 via the spray device 126. The flow regulator 112 also has a second or evacuating state that permits the mixture to exit or evacuate from the compartment 106 via the outlet 122. In one example, the flow regulator 112 is configured to prevent the flow of washing fluid into the compartment in the second state.

Exemplary devices that may be used as either or both of the first flow device 116 and the second flow device 118 include solenoid valves and similar electro-mechanical devices. These devices operate in response to inputs and/or signals provided, e.g., by the controller 114. Coordinated operation of the first flow device 116 and the second flow device 118 implements each of the dispensing state and the evacuation state of the flow regulator 112. In one example, the input changes the configuration of each of the first flow device 116 and the second flow device 118 such as between a first state (e.g., an open state) and a second state (e.g., a closed state). The first state permits the flow of material (e.g., the additive 110, the washing fluid 128, and the mixture) and the second state prevents the flow of material through the respective flow device.

Changing the first flow device 116 between the open state and the closed state regulates the flow of the washing fluid 128 into the compartment 106 such as through the spray device 126. For example, when in the open state, the first flow device 116 permits the washing fluid 128 to fill and/or mix with the additive 110 in the compartment 106. Likewise changing the second flow device 118 between the open state and the closed state regulates the flow of the additive 110, the washing fluid 128, and mixture thereof, from the compartment 106. For double-acting valves, which may be used in certain configurations of the compartment 106, each of the first state and second state prevents flow from one portion of the compartment 106 and permits flow through another portion of the compartment 106.

In one implementation, an amount of the washing fluid 128 is dispersed into the compartment 106 by opening of the first flow device 116 and closing of the second flow device 118. The amount is regulated in one example by changing the state of the first flow device 116 in response to a pre-determined period of time and/or when the washing fluid 128 reaches a pre-determined level in the compartment 106. To stop the flow of the washing fluid 128, the first flow device 116 is closed. Thereafter, an amount of the mixture is evacuated from the compartment 106 by opening the second flow device 118. In one example, the entire contents of the compartment 106 is evacuated, such as when self-cleaning is initiated. In another example, the amount of the mixture is regulated, a feature which is useful to meter the amount of the additive 110 that is provided for use during a wash cycle and/or other operation of the appliance 100 as contemplated herein.

In the present example, the spray device 126 is incorporated into the dispensing device 104. Depending on the embodiment, the spray device 126 is wholly or partially disposed in the compartment 106. The inventors recognize that various configurations of the spray device 126 are useful to effectively disperse and inject the washing fluid 128 into the compartment 106. Therefore the illustration of the spray device 126 in FIG. 1 (or other figures) is not considered limiting in terms of the scope and content of the present disclosure. Rather configurations of the spray device 126 embody one or more characteristics that may be beneficial for cleaning of the compartment 106.

The compartment 106 is suited to accommodate or contain varying amounts the additive 110, the washing fluid 128, and/or the mixture of the two. Volume or capacity of the compartment 106 is selected so as to accommodate enough of the additive 110 for one or more loads of objects, as well as for several days, weeks, and even months without the need to replenish the additive 110. Although the compartment 106 is illustrated in FIG. 1 as a rectangular box-like container, the container may be embodied in any shape and size that is receivable inside of the appliance 100. The container may be flexible, rigid, expandable, or collapsible. The container can be a single unitary structure formed monolithically, or components can formed as separate pieces that are assembled together with fasteners such as adhesives to secure together to form the compartment 106 and/or the dispenser generally.

As illustrated in the example of FIG. 1, the compartment 106 can form a single volume in which is dispensed the additive 110 and the washing fluid 128. In other constructions the dispensing device 104 comprises a plurality of compartments that are in fluid connection so that material (e.g., the additive 110 and the washing fluid 128) flows by gravity therebetween. An example of this construction is discussed next in connection with FIGS. 2 and 3. These figures illustrate a side view (FIG. 2) and a top view (FIG. 3) of an exemplary appliance 200 made in accordance with the present disclosure.

Figure 2:
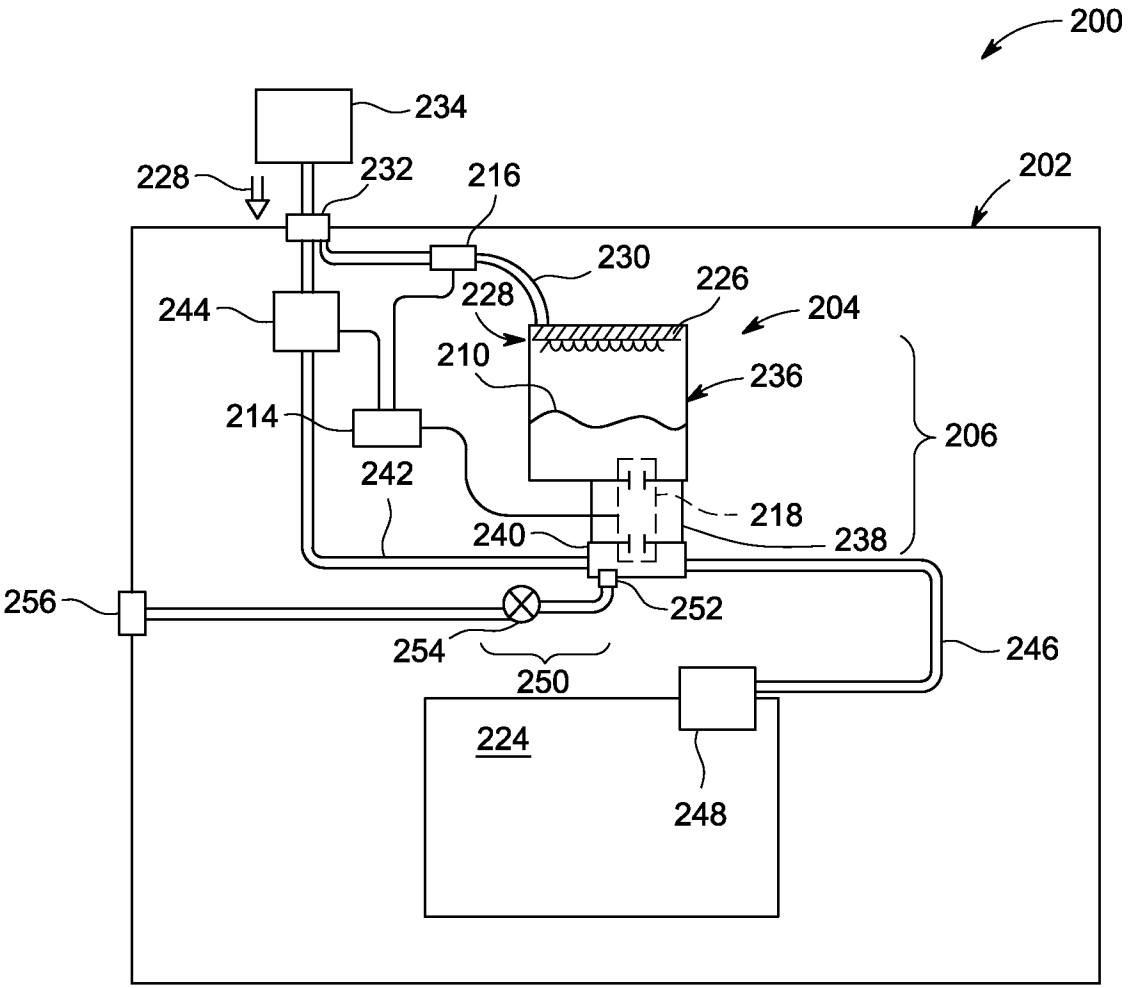
FIG. 2 is a schematic diagram of a side view of another exemplary embodiment of an appliance.
Figure 3:
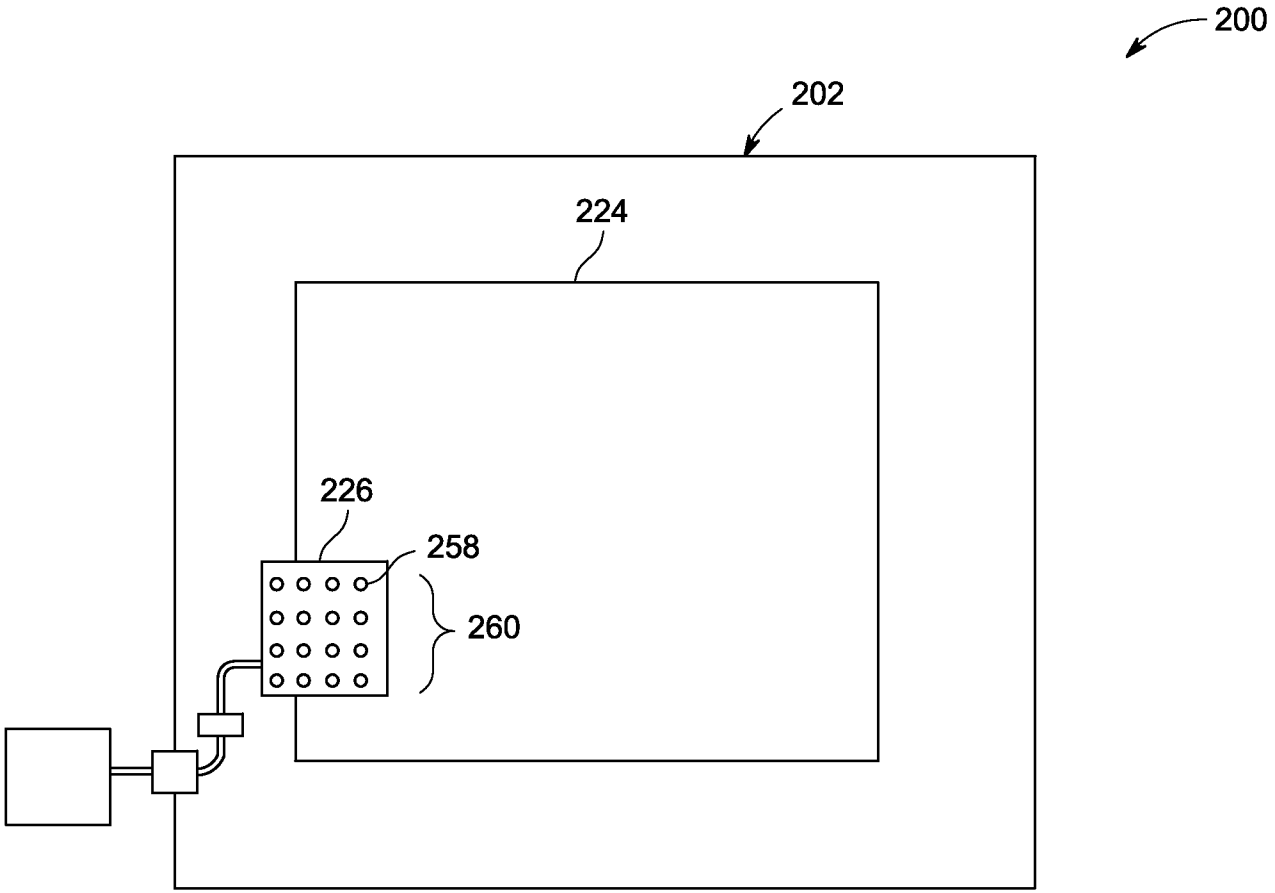
FIG. 3 is a schematic diagram of a top view of the appliance of FIG. 2.

Like numerals are used to identify like components as between FIGS. 1-3, except that the numerals are increased by 100. For example, and referring to FIG. 2, the appliance 200 comprises a washing machine 202 and a dispensing device 204 with a compartment 206 that is used to buffer an additive 210 therein. The appliance 200 also includes a controller 214, a first flow device 216, and a second flow device 218 that is fluidly connected to a wash tub 224. The appliance 200 also includes a spray device 226 that is disposed in and ejects a washing fluid 228 into the compartment 206.

The first flow device 216 is fluidly connected to a spray conduit 230, which directs the washing fluid 228 from a fluid inlet 232 to the spray device 226. In one example the fluid inlet 232 is fluidly connected to a fluid supply 234 such as municipal water or well-water supplies. The compartment 206 is configured with a first compartment 236 (e.g., "an upper compartment 236"), a second compartment 238 (e.g., "a middle compartment 238"), and a third compartment 240 (e.g., "a lower compartment 240"). In one embodiment, the second flow device 218 is positioned to regulate fluid connection between each of the compartments (e.g., fluid connection of the first compartment 236 with the second compartment 238 and fluid connection of the second compartment 238 with the third compartment 240).

An inlet conduit 242 with an inlet valve 244 and an outlet conduit 246 are connected to the third compartment 240. The outlet conduit 246 is connected to a fill funnel 248, which is configured in fluid connection with the wash tub 224. This combination permits the additive 210 and the washing fluid 228 to flow from the third compartment 240 to the wash tub 224. In one embodiment, the appliance 200 further comprises a drain system 250, which is used to drain residual fluids (e.g., the additive 210, the washing fluid 228, and/or the additive/washing fluid mixture) from at least the third compartment 240, the inlet conduit 242, and the outlet conduit 246. The drain system 250 includes a drain valve 252, which is fluidly connected with the third compartment 240, and a pump 254 that is fluidly connected to the drain valve 252 and to a drain 256.

In one embodiment, the dispensing device 204 comprises a material level sensor, which is configured to monitor the level and/or amount of material that is in, e.g., the first compartment 236. The material level sensor can be secured to the compartment 236. Examples of the material level sensor include devices such as pressure sensors and optical sensors. In use in the washing machine 202, the material level sensor provides an input to the controller 214, where the input indicates to the end user a condition of the dispensing device. Exemplary conditions include an empty or low-additive condition in which the level and/or amount of the additive is at, near, or below a threshold level monitored by the material level sensor. The threshold level defines, in one example, a minimum level of the additive present in the dispensing device. These conditions may be used to indicate to the end user to replenish the additive 210, as well as to initiate a flow of the washing fluid 228 such as during a self-cleaning cycle of the dispensing device 204. In one example, the controller 214 automatically initiates the self-cleaning cycle upon receipt of a signal output from the material level sensor that indicates the low-additive condition.

As best shown in FIG. 3, the spray device 226 comprises a plate 260 on which is disposed a plurality of spray jets 258, arranged in an array and configured to disperse the washing fluid 228 into at least the first compartment 236. The spray jets 258 include openings, orifices, and apertures (collectively, "openings") through which flows the washing fluid 228. The openings can be of various sizes, shapes, and arrangements such as would be useful to direct the washing fluid 228 into the compartment 206 such as against the peripheral wall 108 (FIG. 1). The configuration of the openings also influence properties of the washing fluid 228 such as spray velocity and spray direction (from the spray device 226), which may necessitate that the openings include additional elements and/or components that direct the washing fluid 228 as contemplated herein.

In the present example, the spray jets 258 are fluidly connected via features (not shown) incorporated in the plate 260. The features distribute the washing fluid 228 (FIG. 2) throughout all of the spray jets 258. However, other configurations of the spray device 226 are also contemplated, wherein the spray jets 258 are placed in fluid connection using various elements such as tubing, valves, fluid connectors, and the like. That is to say that, while depicted in FIG. 3 as comprising the plate 260, the spray device 226 is amenable to many different constructions that embody the dispensing devices contemplated herein.

Figure 4:
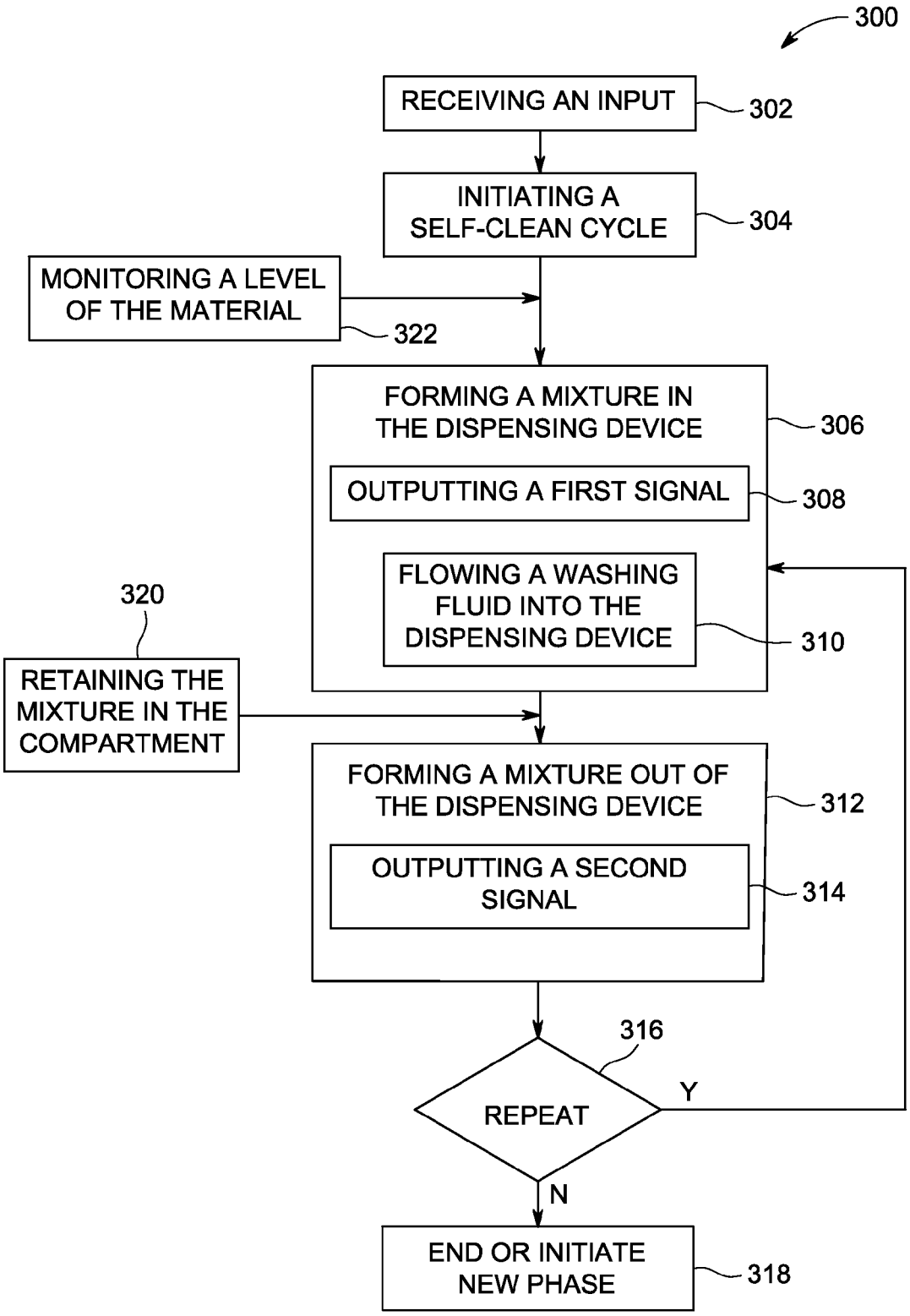
FIG. 4 is a flow diagram of an example of a method of operating an appliance such as the appliances of FIGS. 1-3.
Figure 5:
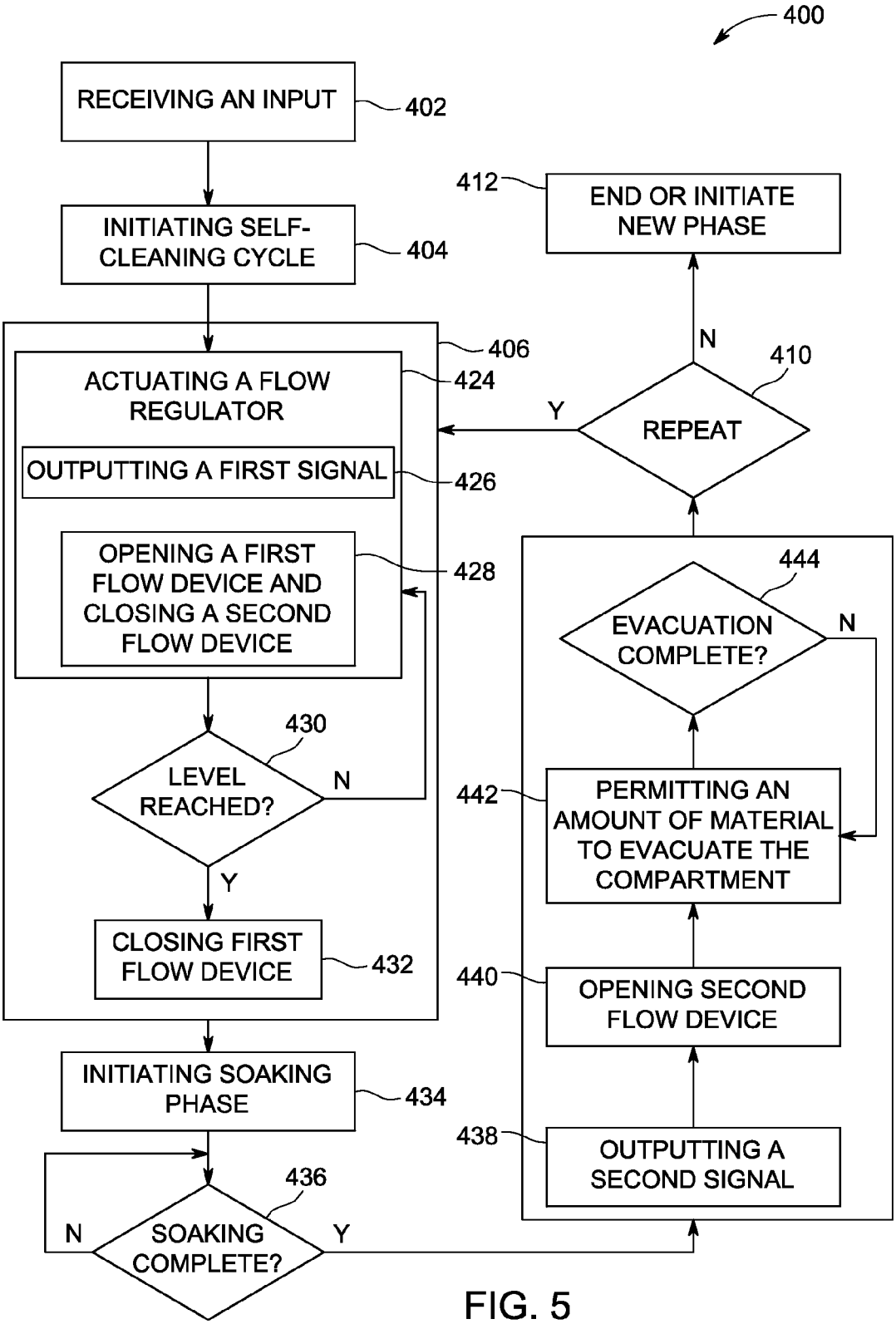
FIG. 5 is a flow diagram of another example of a method of operating an appliance such as the appliances of FIGS. 1-3.

FIGS. 4 and 5 depict flow diagrams of a method 300 (FIG. 4) and a method 400 (FIG. 5). Each of the methods defines an exemplary operation of appliances such as the appliances 100 and 200 discussed above. Turning first to FIG. 4, the method 300 comprises, at block 302, receiving an input and, at block 304, initiating a self-cleaning cycle in response to the input. The method 300 also comprises, at block 306, forming a mixture in the dispensing device such as, at block 308, outputting a first signal to a flow regulator, which when received by the flow regulator changes the state of the flow regulator. In one embodiment, the method 300 comprises, at block 310, flowing a washing fluid into the dispensing device, wherein the flow regulator enters the dispensing state in response to the first signal.

The method 300 also comprises, at block 312, flowing the mixture out of the dispensing device such as, at block 314, outputting a second signal to the flow regulator, which when received by the flow regulator changes the state of the flow regulator. In one example, the flow regulator changes to an evacuation state in which the mixture flows out of the dispensing device. The method 300 further comprises at block 316, determining whether to repeat the self-cleaning cycle, and at block 318, ending the self-clean cycle and/or entering another phase of operation. Also included in one embodiment of the method 300 is, at block 320, retaining the mixture in the compartment, and at block 322, monitoring a level of the material in the dispensing device.

The input may arise automatically from devices that are integrated into the appliance such as the material level sensor above. The input may indicate the low additive condition or other condition in which the dispensing device requires cleaning and/or maintenance. Alternatively, the input arises in response to actions of an end user, such as where the end user actuates one or more controls (e.g., push buttons) that are configured to generate the input. In one embodiment, the control selectors allow changes to the operation and configuration of the appliance. A single control selector can be used such as a push button that is designated for the self-cleaning cycle. In another example, the end user must actuate and/or select a certain number of control selectors, such as where actuation of at least three control selectors is required to generate the input that initiates the self-cleaning cycle.

In another embodiment the controller (e.g., the controller 114, 214) is configured to initiate the self-cleaning cycle automatically. Initiation may occur after receiving a signal from a timing circuit. The signal indicates a pre-determined trigger such as a number of wash cycles, a period of time, and/or a condition of the dispensing device such as the low-additive condition discussed above. These triggers can be pre-set as part of manufacturing and/or factory calibration procedures or the triggers can be selected and established by the end user. In one example, the controller is configured to query, e.g., the material level sensor, and will not initiate the self-clean cycle unless the dispensing device is in the low-additive condition. Although not illustrated in the present examples, if the low-additive condition is not met, then the controller is operatively configured to flow the additive 210 out of the dispensing device until the dispensing device enters the low-additive condition, and then flow the washing fluid into the dispensing device.

Operation is also envisaged in which a combination of integrated functionality and user controls is required to initiate the self-cleaning cycle. In one embodiment, the controller is configured to indicate to the end user that the self-cleaning cycle can/should be initiated. The indication may occur as a result of one or more triggers (e.g., the triggers discussed above). In response to this indication, the end user can select the appropriate controls to initiate the self-cleaning cycle.

Flowing of the washing fluid, the additive, and the mixture into and out of the dispensing device can occur by way of actuation of the flow devices (e.g., the first flow device 116, 216 and the second flow device 118, 218). In one embodiment, the washing fluid 128, 228 originates from a fluid inlet (e.g., the fluid inlet 232), which is connected to a fluid supply (e.g., the fluid supply 234). Operating the flow devices such as by opening the first flow device 116, 216 and closing the second flow device 118, 218 permits the washing fluid 128, 228 to flow into the compartment 106, 206. Introducing the washing fluid 128, 228 forms a mixture, in which is diluted the additive 110, 210 disposed in the compartment 106, 206. To evacuate the mixture from the compartment 106, 206, the second flow device 118, 218 is opened so that the mixture can flow out of the compartment and on to a drain (e.g., the drain 256) or into the wash tub 124, 224. In one embodiment, a pump (e.g., the pump 254) is used in conjunction with operation of the second flow device 118, 218 to remove the mixture from the compartment and/or other parts of the appliance.

Referring next to FIG. 5, the method 400 comprises, at block 402, receiving an input such as a first input from a sensor (e.g., the material level sensor) and/or a second input from the control selectors. The method 400 also comprises, at block 404, initiating a self-cleaning cycle, at block 406, forming a mixture in the dispensing device, and at block 412, flowing the mixture out of the dispensing device. The method 400 also comprises repeating of the self-clean cycle, such as at block 416 and ending and/or initiating a new phase such as at block 418. Other steps that might not be illustrated are also considered to be included as part of the method 400. Some of these steps are discussed herein, while in other embodiments and examples such steps are contemplated within the scope and spirit of the present disclosure.

In one embodiment, the method 400 comprises, at block 424, actuating a flow regulator and, at block 426, outputting a first signal to a first flow device and a second flow device, which in response to the first signal opens the first flow device and closes the second flow device (e.g., at block 428). The method 400 further comprises, at block 430, determining whether the washing fluid has reached its level in the compartment and, if so, then the method continues, at block 432, to close the first flow device. In one embodiment, the method 400 comprises, at block 434, initiating a soaking phase and, at block 436, determining whether the soaking phase is complete.

If the soaking phase is complete, the method 400 continues, including at block 438, outputting a second signal to initiate an evacuating phase in which the mixture is evacuated from the compartment. In one embodiment, this phase comprises, at block 440, opening the second flow device, at block 442, permitting an amount of material to flow out of the compartment, and, at block 444, determining whether the evacuation phase is complete.

For dispensing devices with only a single compartment, such as the compartment 106 of FIG. 1, the second flow device is only actuated to its open state to evacuate substantially all of the materials in the compartment 106. For dispensing devices with multiple compartments, an example of which is depicted as the compartment 206 in FIG. 2, the second flow device may be actuated between the open state and the closed state. This change in states permits in one example material to flow from the first compartment to the second compartment and from the second compartment to the third compartment.

Implementation of methods of operation (e.g., the methods 300, 400) is accomplished by deploying a variety of control configurations. The example of FIG. 6 provides a schematic diagram of one configuration of an exemplary control configuration 500 for use in, e.g., the appliances 100, 200, and related embodiments ("the appliances"). The control configuration 500 includes a controller 502 (e.g., the controller 114, 214), which includes a processor 504, a memory 506, and control circuitry 508 configured for general operation of the appliances. The control circuitry 508 comprises a pump control circuit 510 and a valve control circuit 512, as well as in one example a timing circuit 514. All of these components are operatively connected together and communicate to one another when applicable via one or more busses 516.

The control configuration 500 further includes various flow devices 518 including a first flow device 520 (e.g., the first flow device 116, 216), a second flow device 522 (e.g., the second flow device 118, 218), and an inlet valve 524 (e.g., the inlet valve 244), and a drain valve 526 (e.g., the drain valve 252). In one embodiment, the controller 502 is coupled to a pump 528, a control panel 530 that includes one or more wash cycle controls 532, and to a material level sensor 534 (e.g., the material level sensor).

When implemented in the appliances, the controller 502 effectuates operation of various elements of the appliance such as in response to inputs from the control panel 530. The timing circuit 514, of which various configurations are contemplated, is provided to indicate times and time periods to, e.g., change the configuration of the flow devices as between the open position and the closed position described herein. These time periods may be selected, in connection with or wholly separate from the configuration of the appliance so as to optimize the cleanliness of the compartment and objects in the appliance as contemplated herein.

At a high level, the control configuration 500 and its constructive components are configured to communicate amongst themselves and/or with other circuits (and/or devices), which execute high-level logic functions, algorithms, as well as firmware and software instructions. Exemplary circuits of this type include, but are not limited to, discrete elements such as resistors, transistors, diodes, switches, and capacitors, as well as microprocessors and other logic devices such as field programmable gate arrays ("FPGAs") and application specific integrated circuits ("ASICs"). While all of the discrete elements, circuits, and devices function individually in a manner that is generally understood by those artisans that have ordinary skill in the electrical arts, it is their combination and integration into functional electrical groups and circuits that generally provide for the concepts that are disclosed and described herein.

The electrical circuits of the controller 502 are sometimes implemented in a manner that can physically manifest logical operations, which are useful to facilitate the timing of the phases and cycles of the appliance. These electrical circuits can replicate in physical form an algorithm, a comparative analysis, and/or a decisional logic tree, each of which operates to assign an output and/or a value to the output such as to actuate the flow devices 518 and/or to activate the pump 528.

In one embodiment, the processor 504 is a central processing unit (CPU) such as an ASIC and/or an FPGA. The processor 504 can also include state machine circuitry or other suitable components capable of receiving inputs from, e.g. the control panel 530. The memory 506 includes volatile and non-volatile memory and can be used for storage of software (or firmware) instructions and configuration settings. Each of the pump control circuit 510, the valve control circuit 512, and the timing circuit 514, can be embodied as stand-alone devices such as solid-state devices. These devices can be mounted to substrates such as printed-circuit boards, which can accommodate various components including the processor 504, the memory 506, and other related circuitry to facilitate operation of the controller 502 in connection with its implementation in the fluid dispensing appliances.

However, although FIG. 6 shows the processor 504, the memory 506, the pump control circuit 510, the valve control circuit 512, and the timing circuit 514 as discrete circuitry and combinations of discrete components, this need not be the case. For example, one or more of these components can be contained in a single integrated circuit (IC) or other component. As another example, the processor 504 can include internal program memory such as RAM and/or ROM. Similarly, any one or more of functions of these components can be distributed across additional components (e.g., multiple processors or other components).

As mentioned above, the concepts presented in the foregoing discussion are compatible with various configurations of appliances. While this discussion is focused on washing machines, it is contemplated that at least some of the benefits of the concepts recited herein can be realized in on various types of appliances. These concepts are therefore not intended to be limited to any particular type or configuration of appliances, such as the configuration and features of the appliances 100, 200 above.

Figure 8:
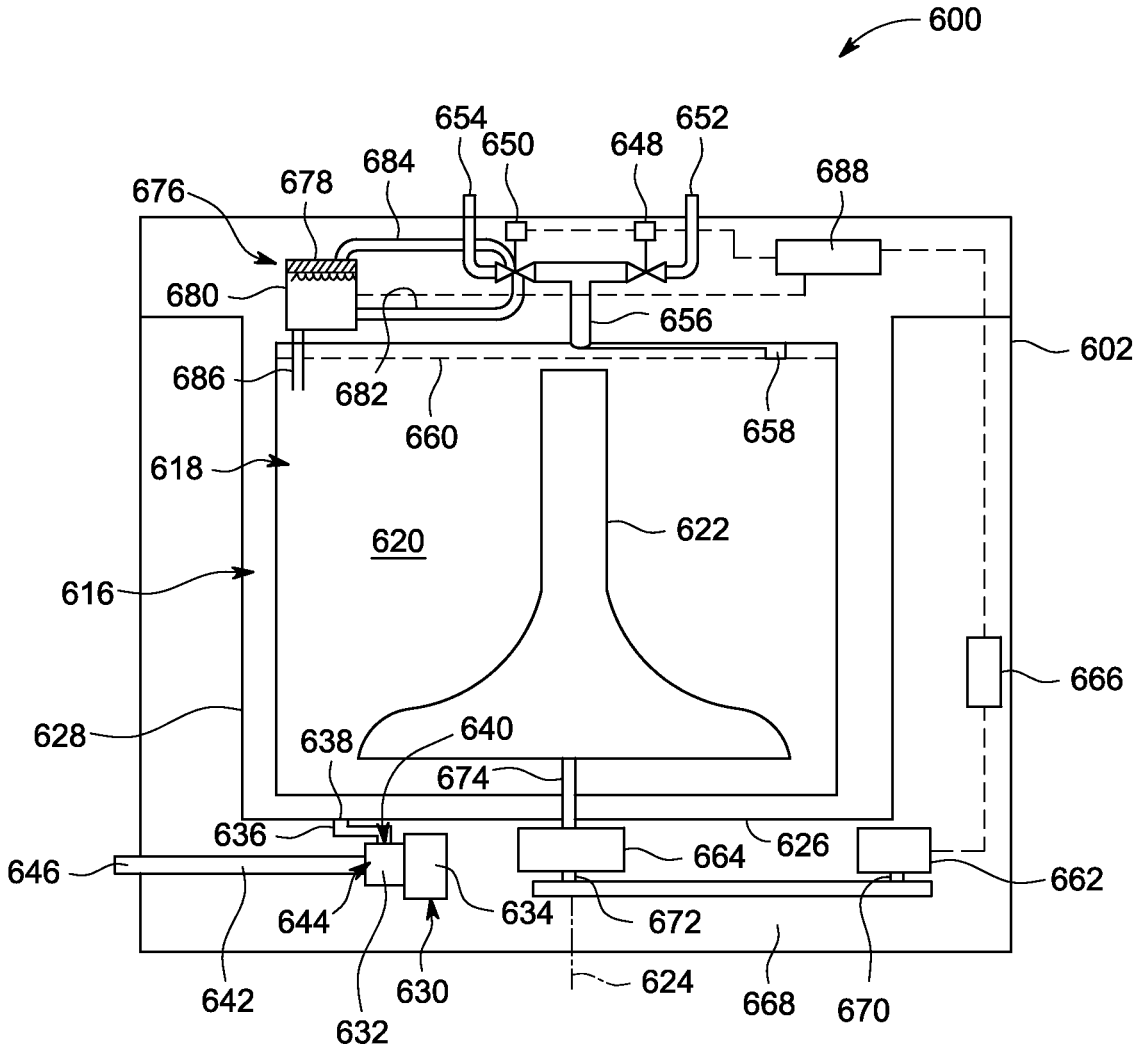
FIG. 8 is an elevational, schematic view of the washing machine shown in FIG. 6.

In this connection, and to further clarify at least one implementation of the concepts herein, reference can now be had to FIGS. 7 and 8 in which is depicted an example of a vertical-axis washing machine 600. As depicted in FIGS. 7 and 8, the illustrated washing machine 600 includes a cabinet 602, 604. A backsplash 606 extends from the cabinet 602, 604 and a control panel 608 including a plurality of input selectors 610 is coupled to the backsplash 606. As is known and understood by those skilled in the art, the control panel 608 and the input selectors 610 can collectively form a user interface input for operator selection of machine cycles and features. A display 612 can indicate the selected features, a countdown timer, and/or other items of interest to machine users. A lid 614 is mounted to the cover 604 and is pivotable about a hinge (not shown) between an open position facilitating access to a wash tub 616 (FIG. 8) (e.g., the wash tub 124, 224) located within the cabinet 602, 604, and a closed position (as shown) forming an enclosure over the wash tub 616.

With particular reference to FIG. 8, the wash tub 616 is located or positioned within the cabinet 602, 604 and a basket 618 is movably disposed and rotatably mounted within the wash tub 616. As is known and understood by those skilled in the art, the basket 618 can include a plurality of apertures or perforations (not shown) to facilitate fluid connection between an interior 620 of the basket 618 and the wash tub 616. An agitation element 622, such as an agitator, impeller, auger, oscillatory basket mechanism, etc., or a combination of the foregoing, is disposed in the basket 618 to impart motion to the articles or wash load within the basket 618. In particular, in the illustrated embodiment, the agitation element 622 is a vane agitator rotatably positioned within the basket 618 on vertical axis 624 for imparting motion to articles and liquid received within the basket 618.

The wash tub 616 includes a bottom wall 626 and a side wall 628, the basket 618 being rotatably mounted or supported within the wash tub 616 in spaced apart relation from the bottom wall 626 and the side wall 628. A pump assembly 630 is located beneath the wash tub 616 and the basket 618 for gravity assisted flow when draining the wash tub 616. The pump assembly 630 includes a pump 632, a motor 634, and in an exemplary embodiment a motor fan (not shown). A pump inlet hose 636 extends from a wash tub outlet 638 in bottom wall 626 to a pump inlet 640, and a pump outlet hose 642 extends from pump outlet 644 to a drain outlet 646 and ultimately to a building plumbing system discharge line (not shown) in fluid connection with the drain outlet 646. In operation, pump assembly 630 can be selectively activated to remove liquid from the basket 618 and the wash tub 616 through drain outlet 646 during appropriate points in washing cycles as washing machine 600 is used.

A hot liquid valve 648 and a cold liquid valve 650 deliver fluid, such as water, to the basket 618 and the wash tub 616 through a respective hot liquid hose 652 and a cold liquid hose 654. Liquid valves 648, 650 and liquid hoses 652, 654 together form a liquid supply connection for the washing machine 600 and, when connected to a building plumbing system (not shown), provide a water supply for use in the washing machine 600. Liquid valves 648, 650 and liquid hoses 652, 654 are connected to a basket inlet tube 656, and fluid can be dispersed from the basket inlet tube 656 through a nozzle assembly 658 having a number of openings therein to direct washing liquid into basket 618 at a given trajectory and velocity.

In an alternate embodiment, a spray fill conduit 660 (shown in phantom in FIG. 8) can be employed in lieu of the nozzle assembly 658. Along the length of the spray fill conduit 660 can be a plurality of openings (not shown) arranged in a predetermined pattern to direct incoming streams of water in a downward tangential manner towards a wash load in the basket 618. The openings in the spray fill conduit 660 can be located a predetermined distance apart from one another to produce an overlapping coverage of liquid streams into the basket 618. The wash load in the basket 618 may therefore be uniformly wetted even when the basket is maintained in a stationary position, of course, any other type of nozzle or spray fill conduit could be used in the washing machine 600.

In an exemplary embodiment, the basket 618 and the agitation element 622 are driven by a motor 662 through a transmission and clutch system 664. The motor 662 is driven by an inverter 666. A transmission belt 668 is coupled to respective pulleys of a motor output shaft 670 and a transmission input shaft 672. Thus, as motor output shaft 670 is rotated, transmission input shaft 672 is also rotated. Clutch system 664 facilitates driving engagement of the basket 618 and the agitation element 622 through shaft 674 for rotatable movement within the wash tub 616, and clutch system 664 facilitates relative rotation of the basket 618 and the agitation element 622 for selected portions of wash cycles. Motor 662, transmission and clutch system 664 and transmission belt 668 can collectively be referred to as a machine drive system, the drive system being drivingly connected to the basket 618 and the agitation element 622 for rotating the basket 618 and/or the agitation element 622.

In the illustrated embodiment, the washing machine 600 further includes a dispensing device 676 mounted in the cabinet 602, 604 for dispensing an additive, such as a detergent, bleach, fabric softener, etc., or any combination of the foregoing, into the wash tub 616 and/or basket 618. The dispensing device 676 can be provided as part of a bulk dispensing system integrated into the washing machine 600 or any other type of automatic or semi-automatic filling and/or dispensing system. In one embodiment, the dispensing device 676 can include a spray device 678 disposed in a compartment 680 for receiving and holding the laundry additive, the tank compartment being configured as discussed in connection with the compartment 106, 206 of FIGS. 1-3 and related embodiments. It is also contemplated that the washing machine 600 and related embodiments can employ a plurality of the compartments 680 such as could be used to hold additives of different varieties.

Referring back to FIG. 8, there is also shown that a first inlet conduit 682 fluidly connected to the compartment 680 and a second inlet conduit 684 is fluidly connected to the spray device 678. Each of the first inlet conduit 682 and the second inlet conduit 684 is also fluidly connected to one or more of the hot liquid valve 648 and the cold liquid valve 650 so as to facilitate flushing the laundry additive out of the compartment 680 and into the wash tub 616. An outlet conduit/nozzle 686 is provided for directing any amount of the laundry additive that is released into the wash tub 616 and/or basket 618. In one embodiment, the compartment 680 is mounted on an inside wall of the cabinet 602, 604 at an upper portion thereof and can be filled manually when the lid 614 is opened.

Operation of the washing machine 600 can be controlled by a controller 688 (e.g., the controller 502 of FIG. 5). For example, the controller 688 can be operatively connected to the user interface input located on the backsplash 606 for user manipulation to select washing machine cycles and features. In response to user manipulation of the user interface input, the controller 688 operates the various components of the washing machine 600 to execute selective machine cycles and features. The controller 688 can also be operatively coupled to the motor 662, the nozzle assembly 658 (or alternatively the spray fill conduit 660), and/or the dispensing device 676.

In view of the foregoing, embodiments of a dispensing device are described and configured for self-cleaning. These features facilitate the change from one additive to another, providing in one example a hands-free way to prepare the dispensing device for the new additive. Moreover, in addition to product change-over, the self-cleaning features and concepts provide maintenance capabilities that are useful to reduce clogging as well as to ensure reliable operation of the dispensing device.

Where applicable it is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

This written description uses examples to disclose embodiments of the invention, including the best mode, and also to enable any person skilled in the art to practice the invention, including making and using any devices or systems and performing any incorporated methods. The patentable scope of the invention is defied by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An appliance, comprising:

a wash tub forming a wash zone in which objects can be positioned to be washed;

a fluid supply for delivering washing fluid to the wash zone;

a dispensing device comprising a compartment configured to store an additive and comprising an inlet for receiving washing fluid from the fluid supply and an outlet for dispensing a mixture of additive and washing fluid to the wash zone;

a controller configured to control the dispensing device in a dispensing state wherein a regulated amount of the mixture is dispensed from the compartment into the wash zone, and a self-cleaning state wherein the compartment is flushed with washing fluid and the entire contents of the compartment are evacuated to remove any additive residue from the compartment; and a flow regulator fluidly connecting the fluid supply to the input of the dispensing device and fluidly connecting the outlet of the dispensing device to the wash zone, wherein the controller is configured to control the flow regulator in a first state in which the washing fluid is dispensed into the compartment via the inlet to form the mixture and a second state in which the regulated amount of the mixture is evacuated from the compartment via the outlet during the dispensing state and the entire contents of the compartment are evacuated via the outlet during the self-cleaning state.

2. An appliance according to claim 1, wherein the flow regulator is configured to prevent the flow of washing fluid into the compartment in the second state.

3. An appliance according to claim 1, wherein the compartment is configured so the washing fluid flows by gravity from the outlet.

4. An appliance according to claim 3, wherein the compartment comprises a first compartment and a second compartment, and wherein the flow regulator is configured to place in fluid connection the first compartment with the second compartment in the second state.

5. An appliance according to claim 1, wherein said dispensing device further comprises a spray device fluidly connected to the inlet.

6. An appliance according to claim 5, wherein the spray device comprises spray jets arranged in an array and through which the washing fluid is directed on to a peripheral wall of the compartment.

7. An appliance according to claim 6, wherein the array is integrated on a plate that is disposed in the compartment.

8. An appliance according to claim 1, further comprising a material level sensor coupled to the controller and to the compartment, wherein the material level sensor is configured to provide to the controller an input indicative of an amount of additive in the compartment.

9. An appliance according to claim 1, wherein the dispensing device is configured for additive in liquid form.

10. A method of operation for the appliance of claim 1, said method comprising:

receiving an input indicative of a condition in which the dispensing device requires cleaning;

outputting a first signal to the flow regulator, which when received by the flow regulator changes the state of the flow regulator to dispense washing fluid into the compartment of the dispensing device in which additive can be disposed; and outputting a second signal to the flow regulator, which when received by the flow regulator changes the state of the flow regulator to evacuate the mixture formed in the compartment, the mixture comprising the washing fluid.

11. A method according to claim 10, further comprising initiating a self-cleaning cycle.

12. A method according to claim 10, further comprising maintaining the flow regulator in the first state until a level for the washing fluid is reached and changing the flow regulator to the second state to evacuate the washing fluid from the compartment.

13. A method according to claim 12, wherein the flow regulator is configured to change from the first state to the second state in response to expiration of a pre-determined time period.

14. A method according to claim 10, wherein the input arises from a user interface input.

15. A method according to claim 14, wherein the input indicates actuation of a control selector.

16. A method according to claim 15, wherein the input indicates actuation of at least three of the control selector.

17. A method according to claim 15, wherein the input comprises a first input respecting an amount of additive that is in the compartment.

18. A method according to claim 17, wherein the input comprises both the first input respecting the amount of additive and a second input respecting actuation of the control selector.

19. A method according to claim 10, wherein the flow regulator is configured to permit dispensing and evacuating to occur simultaneously.

* * * * *